US008925532B2

(12) United States Patent
Makarov et al.

(10) Patent No.: US 8,925,532 B2
(45) Date of Patent: Jan. 6, 2015

(54) POWER SUPPLY CONTROL FOR SPARK PLUG OF INTERNAL COMBUSTION ENGINE

(75) Inventors: Maxime Makarov, Viroflay (FR); Frédéric Auzas, Paris (FR)

(73) Assignee: Renault S.A.S., Boulogne-Billancourt (FR)

( * ) Notice: Subject to any disclaimer, the term of this patent is extended or adjusted under 35 U.S.C. 154(b) by 998 days.

(21) Appl. No.: 12/996,504

(22) PCT Filed: May 5, 2009

(86) PCT No.: PCT/FR2009/050818

§ 371 (c)(1), (2), (4) Date: Feb. 28, 2011

(87) PCT Pub. No.: WO2009/147335

PCT Pub. Date: Dec. 10, 2009

(65) Prior Publication Data

US 2011/0139135 A1 Jun. 16, 2011

(30) Foreign Application Priority Data

Jun. 5, 2008 (FR) ..... 08 53737

(51) Int. Cl.
*F02P 3/04* (2006.01)
*F02P 23/04* (2006.01)
*F02P 9/00* (2006.01)

(52) U.S. Cl.
CPC ..... *F02P 23/04* (2013.01); *F02P 9/002* (2013.01); *F02P 9/007* (2013.01)
USPC ..... 123/623; 123/143 B; 123/606

(58) Field of Classification Search
CPC ..... F02P 9/002; F02P 9/007; F02P 15/10; F02P 23/04; F02P 23/045
USPC ..... 123/143 B, 169 EL, 169 R, 597, 598, 123/606–608, 619, 620, 623, 636, 637, 638, 123/639; 315/111.21, 208, 209 T; 307/10.1; 313/141; 361/263
See application file for complete search history.

(56) References Cited

U.S. PATENT DOCUMENTS 3,974,412 A * 8/1976 Pratt, Jr. ..... 313/131 R
4,181,112 A * 1/1980 Grather et al. ..... 123/606

(Continued)

FOREIGN PATENT DOCUMENTS

DE 10 2004 039259 2/2006
FR 2 878 086 5/2006

(Continued)

OTHER PUBLICATIONS

Briels et al., "Circuit dependence of the diameter of pulsed positive streamers in air", Dec. 1, 2006, Journal of Physics D: Applied Physics, p. 5201-5210.*

(Continued)

*Primary Examiner* — Mahmoud Gimie
*Assistant Examiner* — John Zaleskas
(74) *Attorney, Agent, or Firm* — Oblon, Spivak, McClelland, Maier & Neustadt, L.L.P.

(57) ABSTRACT

A method for controlling the power supply of a radiofrequency spark plug in an internal combustion engine up to an electric voltage sufficient for generating a highly branched spark. To this end, the electric voltage for powering the spark plug is increased step by step up to an adequate voltage adapted for ignition.

9 Claims, 2 Drawing Sheets

(56) References Cited

U.S. PATENT DOCUMENTS

| | | | | |
|---|---|---|---|---|
| 4,525,140 | A * | 6/1985 | Larigaldie et al. | 431/258 |
| 4,589,398 | A * | 5/1986 | Pate et al. | 123/596 |
| 4,996,967 | A * | 3/1991 | Rosswurm et al. | 123/598 |
| 5,107,392 | A * | 4/1992 | Sohner et al. | 361/253 |
| 5,649,507 | A * | 7/1997 | Gregoire et al. | 123/143 B |
| 7,741,761 | B2 * | 6/2010 | Jaffrezic et al. | 313/141 |
| 2004/0129241 | A1 * | 7/2004 | Freen | 123/143 B |
| 2005/0016456 | A1 * | 1/2005 | Taguchi et al. | 118/723 E |
| 2007/0266979 | A1 * | 11/2007 | Nagamine et al. | 123/143 B |
| 2009/0031984 | A1 * | 2/2009 | Shiraishi et al. | 123/260 |
| 2009/0031988 | A1 * | 2/2009 | Shiraishi et al. | 123/406.19 |
| 2009/0126668 | A1 * | 5/2009 | Shiraishi et al. | 123/145 A |
| 2009/0126684 | A1 * | 5/2009 | Shiraishi et al. | 123/406.12 |
| 2009/0146542 | A1 | 6/2009 | Jaffrezic et al. | |

FOREIGN PATENT DOCUMENTS

| | | | |
|---|---|---|---|
| FR | 2 895 169 | 6/2007 | |
| WO | WO 2007113407 A1 * | 10/2007 | F02P 3/01 |

OTHER PUBLICATIONS

International Search Report issued Dec. 4, 2009 in PCT/FR09/050818 filed May 5, 2009.

U.S. Appl. No. 13/257,427, filed Sep. 19, 2011, Makarov, et al.

* cited by examiner

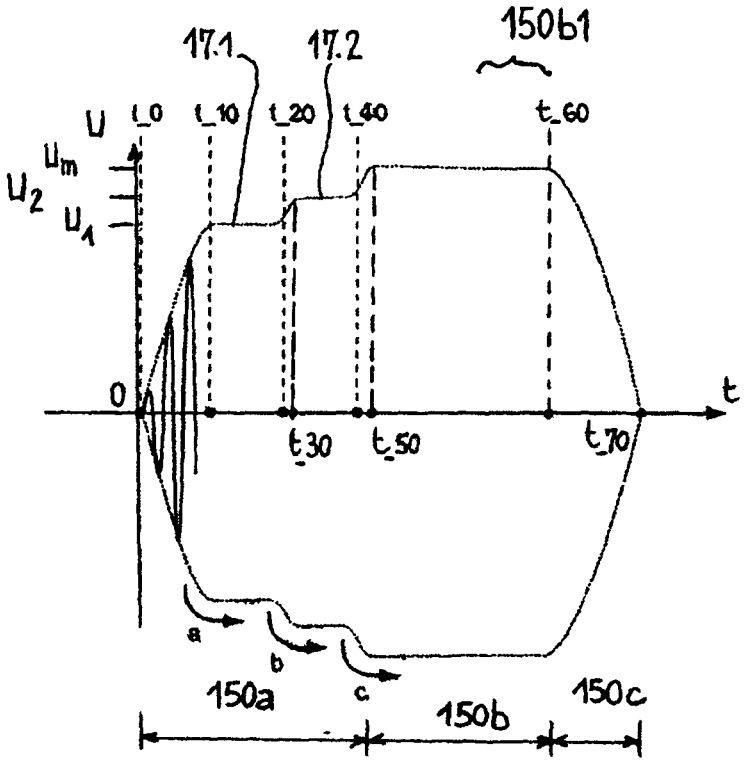
FIG_3
FIG_4
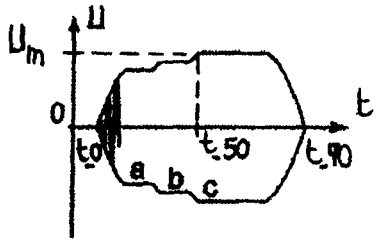
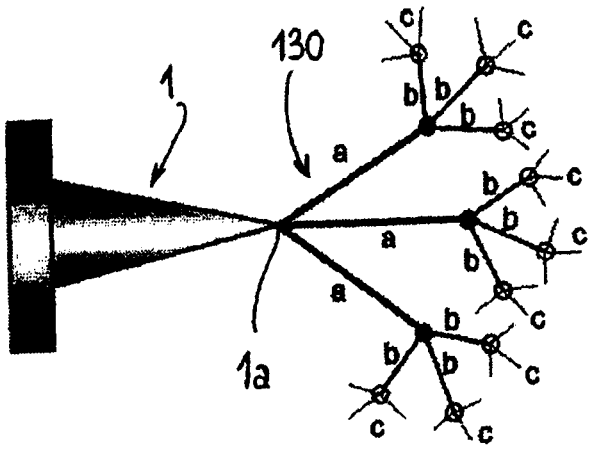
FIG_5

POWER SUPPLY CONTROL FOR SPARK PLUG OF INTERNAL COMBUSTION ENGINE

BACKGROUND

This involves a method for electrically powering an ignition spark plug up to an electric voltage ensuring the generation of a branched ignition spark in particular of an internal combustion engine.

Also involved is a device for powering such a spark plug, this device comprising means for powering the spark plug with electrical energy up to a voltage ensuring the generation of a branched ignition spark.

In order to have better control over igniting the flammable mixture in an internal combustion engine, it is known to be preferable to use an electric spark of considerable size. Specifically, the larger the spark, the greater the probability of there being a meeting between the hot electric arc and the cloud of fuel and the more efficient the ignition. For a conventional ignition spark plug, the size of the spark (of the order of one mm cubed) is limited by the distance between two electrodes of the spark plug.

In order to increase the size of the spark of an ignition spark plug, it has already been proposed:

- in U.S. Pat. No. 5,623,179, to increase the distance between the electrodes of the spark plug; however such a solution requires a particularly high powering voltage, which is directly proportional to the distance between the electrodes,
- in EP-A-1202411 or EP-A-1526618, to use the electric arc which slides over the insulation of the spark plug, which makes it possible to lengthen the spark without increasing the electric voltage by too much; however, in such a solution, the lengthening of the spark remains relatively short and the insulating surface touched by the hot arc quickly degrades;
- in FR-A-2886776 or FR-A-2878086, to form a multifilament radio frequency spark developing from a single pointed electrode; this makes it possible to increase notably the length of the spark, but in the known method of this solution, the number of filaments formed simultaneously is limited (2-3 at most).

BRIEF SUMMARY

The object of the present invention is to prevent the performance limitations of the solutions of the prior art.

Another object is to increase notably the degree of branching of the radio frequency spark (that is to say the total number of filaments generated simultaneously) and thus increase this spark and therefore its efficiency in igniting the mixture entering its environment.

One solution proposed for at least approaching this (these) object(s) is that the electric power supply of the spark plug (in particular a radio frequency spark plug) comprises a step of increasing by stages (therefore with at least one such stage) the power-supply voltage of this spark plug up to the adapted ignition voltage.

In terms of device, it is also proposed that the means for supplying the spark plug with electrical energy be adapted to generate a first voltage for igniting the spark and subsequently to increase this first electric voltage by stage(s) up to said adapted ignition voltage.

BRIEF DESCRIPTION OF THE DRAWINGS

A more detailed description of the invention follows, with reference to the accompanying drawings supplied in a non-limiting manner and in which.

DETAILED DESCRIPTION

Figure 1:
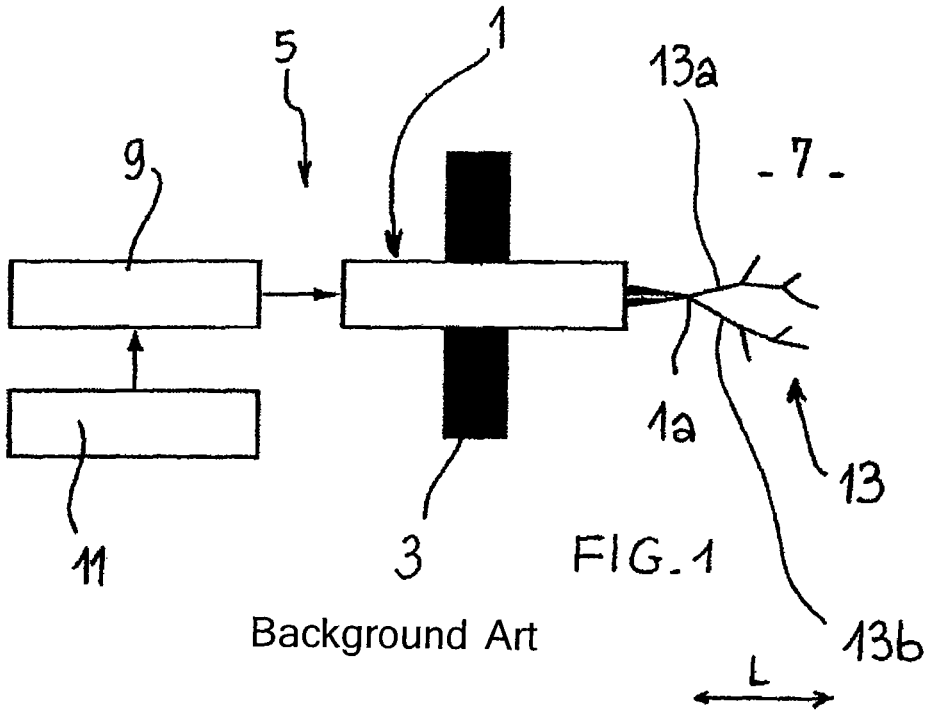
FIG. 1 Background Art
FIG. 1 schematizes a radio frequency spark plug mounted on an internal combustion engine, FIG. 2 schematizes a typical time/voltage evolution on RF spark plugs controlled in the conventional manner, FIGS. 3, 4 schematize an example of time/voltage evolution according to the invention on an RF spark plug controlled in a different manner, and FIG. 5 schematizes a branched spark that can be obtained with the control according to FIGS. 3, 4; as compared with the spark of FIG. 1.

FIG. 1 shows a radio frequency (RF) resonant spark plug 1 mounted on the cylinder head 3 of an internal combustion engine 5. The tip 1*a* of the spark plug leads into the combustion chamber 7 of the engine into which the mixture to be ignited is injected.

This RF plasma spark plug 1 is excited by a low-voltage RF power supply 9 controlled by a computer 11 onboard the vehicle provided with said engine. Each multifilament spark 13 is therefore formed from the single tip 1*a* of the spark plug.

The general known operating mode of such a spark plug is described for example in FR-A-2878086, FR-A-2886776 or FR-A-2888421.

Figure 2:
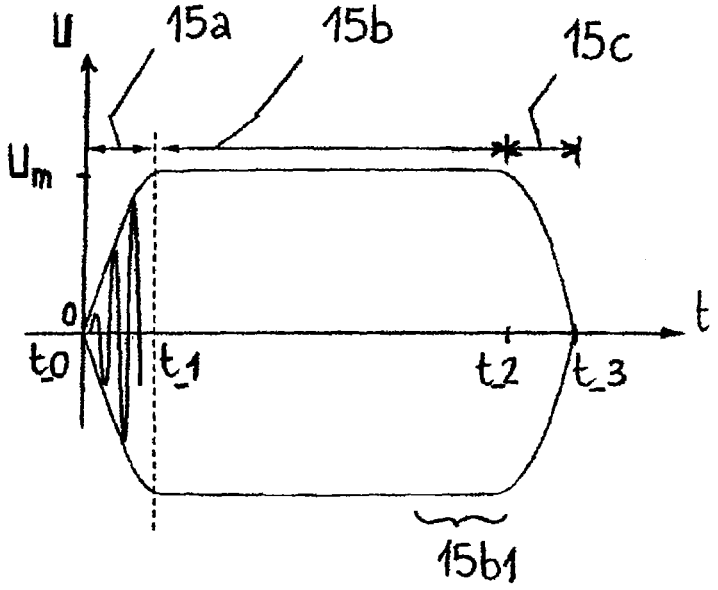
FIG. 2 Background Art

As schematized in FIG. 2, which therefore illustrates the prior art, there are typically two main phases for electrically powering the RF spark plug 1:

During the initial phase 15*a*, which begins at the moment t_0 on applying voltage, the electric voltage U applied to the spark plug increases continuously so that the thin electric channels 13 form from the tip 1*a* of the spark plug.

Once formed, such a multifilament structure is, during the next phase 15*b* (between t_1 and t_2, FIG. 1), heated up to several thousands of ° C. by the electric current supplied by the controlled RF power supply 9. The electric voltage (substantially Um) applied to the spark plug remains (about) constant throughout this second phase.

At the end of this heating phase (portion 15*b*1 up to t_2), the hot filaments cause the mixture to ignite in the cylinder of the internal combustion engine with which the combustion chamber 7 is associated.

Then, during the final phase 15*c* of this cycle for igniting the mixture via the spark plug (between t_2 and t_3, FIG. 1), the electric voltage applied to this spark plug again reduces continuously until it disappears.

The length L (of the order of one cm; FIG. 1) of the filaments 13 formed at the end of the phase 15*b*1 depends only on the maximum amplitude of the voltage U applied to the tip 1*a*.

So long as, during the heating phase 15*b*/15*b*1, the amplitude of the RF voltage Um, corresponding to the maximum electric voltage (or adapted ignition voltage) applied to the tip of the spark plug, is kept stable (constant), the length of the filaments 13 and their number no longer change or virtually no longer change.

The inventors have noted that, in this known operating mode, the degree of branching (that is to say the number of bifurcation points, as marked 13*a*, 13*b*, FIG. 1) of the RF spark 13 remains relatively low: the filaments formed during the formation phase are rather straight with few bifurcation points (typically 2-3 at most) which limits the size of the spark.

In order to increase the degree of branching of the multifilament spark, the inventors propose to modify the method of electrically powering the RF spark plug 1, as illustrated in particular in FIG. 3.

Therefore, instead (as in FIG. 2) of applying to the tip of the electrode 1*a* of the spark plug a voltage such that at a moment t_1 (end of the initial phase 15*a*) immediately following t_0, the maximum voltage Um (the adapted ignition voltage for combustion) is present there after a continuous increase in this voltage from the beginning of supplying power (moment t_0), a step of increasing by stage(s), up to said maximum voltage Um, the electric voltage for powering the spark plug will be applied.

FIG. 3 shows such a voltage increase in several stages, in this instance two: 17.1 and 17.2.

Consequently it is found that, with the solution of the invention, and in the exemplary embodiment shown in FIG. 3, the electric voltage will initially, between t_0 and t_10, increase only up to a value U1 that is just necessary for the formation of the $1^{st}$-generation filaments 130, namely those marked "a" notably in FIG. 5, which all originate from the tip 1*a* of the electrode of the spark plug.

At the moment t_10, that is to say typically a few μs after the beginning of excitation at t_0 (from 5 to 10 μs in the proposed embodiment), the RF power supply stabilizes the amplitude of the applied voltage and holds it substantially at U1 for a few μs (from 2 to 5 μs in the proposed embodiment) until the moment t_20.

It is the $1^{st}$ heating phase corresponding to the stage 17.1.

Advantageously, the value U1 of the electric voltage at this first voltage stage 17.1 will be just necessary for the formation, at the free end 1*a* of the electrode, of electric filaments originating from this end.

During this period of time, the temperature of the primary filaments 130 "a" reaches 1000-5000° C., the gas inside the channels becomes heavily ionized, its electrical resistivity falls from infinity to a few kOhms only. As a result, the voltage of the spark plug is applied to the ends of the filaments "a" that have become conducting (the solid points in FIG. 5).

Between the moments t_20 and t_30, the RF power supply again (continuously) increases the amplitude of the voltage of the spark plug up to the intermediate voltage U2 (where naturally U2 is greater than U1).

Preferably, the voltage difference between the zero voltage and the U1 voltage of the first voltage stage will be greater than the electric voltage difference between the electric voltage U1 of the first voltage stage and said adapted ignition voltage Um, as schematized in FIGS. 3, 4.

Because the diameter of the ionized filaments 130 (typically of the order of 50-100 μm) is substantially smaller than that of the tip (typically of the order of 500 μm), all that is needed is a small increase in the electric voltage U applied for the local electric field at the ends of the filaments 130 "a" (inversely proportional to the square of their diameter) to be great enough to cause the formation of the $2^{nd}$-generation filaments. This time, the new filaments, marked 130 "b", still in FIG. 3, originate from the ends of the filaments "a" and no longer from the tip 1*a* of the spark plug.

During the period of time between t_30 and t_40 the filaments "b" are heated. The voltage is again stabilized, in this instance at U2, which corresponds to the second stage 17.2. The potential of the tip is then at the ends of the latter (the open points in FIG. 5).

Again between the moments t_40 and t_50, the RF power supply again increases the voltage of the spark plug 1*a*, causing the birth of the $3^{rd}$ generation of filaments 130 "c" from the ends of the filaments of the previous generation.

The process could continue further. In FIGS. 3, 4, 5 it has been considered that it stops there, since it was supposed that the adapted ignition voltage Um was reached at the moment t_50.

Therefore, according to a worthwhile feature of the invention for achieving the intended objects, between the initial moment t_0 of beginning to electrically power the spark plug and the stabilized application of the maximum voltage at t_50, at least one stage of stabilized electric voltage has been produced for a period of between 1 and 10 μs.

Once formed with its branches of successive generations of filaments 130 *a, b, c* (initial phase 150*a* of increasing voltage by stages), such a multifilament structure is, during the next phase 150*b*, heated (as before) up to several thousands of ° C. by the electric current supplied by the controlled RF power supply 9. The electric voltage (Um) applied to the spark plug remains (substantially) constant throughout this second phase, as shown in FIG. 3.

Again as in the conventional operating mode, at the end of this heating phase (portion 150*b*1 up to the moment t_60), the hot filaments cause the ignition of the mixture in the cylinder of the internal combustion engine with which the combustion chamber 7 is associated.

And, during the final phase 150*c* of this cycle for igniting the mixture via the spark plug, the electric voltage applied to this spark plug again reduces continuously until it disappears (moment t_70).

Preferably, a period of voltage stages will be applied between two voltage increases (such as t_10–t_20 and t_30–t_40)—that is greater than the elapsed time between two successive stages of increase of said voltage (such as t_20–t_30).

The "formation of filaments→their heating→increase in voltage→formation . . . →heating . . . →increase . . . " cycle can be repeated as many times as necessary. On each further increase in the voltage, the new bifurcation points appear.

Therefore, the means for powering with electrical energy 9, 11 will have been adapted relative to the prior situation of FIG. 2 in order, progressively with the stages 17.1 . . . beyond the first voltage U1 for igniting the spark, to generate the creation of new branches 130*b* . . . at the (round, solid) end(s) of the electric spark created at the first stage.

Finally, the spark 130 generally formed in this way is characterized by a degree of branching that is much greater than in the case of the conventional excitation schematized in FIG. 2. It is possible to estimate the total number of filaments at $$N_{total} \approx \sum_{k=1}^{n} N_0^k,$$

where N0 is the number of filaments of one generation and n the number of cycles. Therefore, in the situation illustrated in FIG. 5 where N0≈3 and n=3 Ntotal≈39 or approximately 10 times more than in the case of conventional RF excitation. Even though the average length of the filaments of each new generation is increasingly short, the total overall length of the spark at the end of its powering is much greater than in the case of the conventional powering (see FIGS. 1 and 5). This increases the probability of an encounter between the hot arc and the fuel/air mixture and therefore makes the ignition more efficient.

Naturally, it will have been noted in FIGS. 2 to 4 that the electric voltages in question (Um, U1 . . . ) are alternatives, the sinusoidal curve of evolution of the voltage U schematized on the left, with its first alternations, being clear in this respect.

The invention claimed is:

1. A method for electrically powering an ignition spark plug of a combustion engine to an electric voltage adapted to ensure generation of a branched ignition spark, the method comprising:

increasing the electric voltage for powering the spark plug from a zero voltage to a first voltage stage created at an electric voltage value just necessary for formation, at a free end of an electrode of the spark plug, of first electric filaments originating from the free end;

after the increasing the electric voltage to the first voltage stage, stabilizing the electric voltage at the first voltage stage for a predetermined time period; and after the stabilizing the electric voltage, increasing the electric voltage up to the adapted voltage.

2. The method as claimed in claim 1, wherein the predetermined time period during which the electric voltage is stabilized at the first voltage stage is between 1 and 10 μs.

3. The method as claimed in claim 1, wherein a voltage difference between the zero voltage and that of the first voltage stage is greater than an electric voltage difference between the electric voltage of the first voltage stage and the adapted voltage.

4. The method as claimed in claim 1, further comprising: after stabilizing the electric voltage at the first voltage stage, increasing the electric voltage from the first voltage stage to a second voltage stage that is less than the adapted voltage, the second voltage stage being an electric voltage value just necessary for formation of second electric filaments originating from ends of the first electric filaments.

5. The method as claimed in claim 4, wherein the electric voltage is increased up to the adapted voltage after the second voltage stage.

6. The method as claimed in claim 4, wherein the predetermined time during which the electric voltage is stabilized at the first voltage stage is greater than an elapsed time during which the electric voltage is increased from the first voltage stage to the second voltage stage.

7. A device for powering an ignition spark plug, the device comprising:

means for powering the spark plug with electric voltage up to an adapted ignition voltage for generating a branched spark, wherein the means for powering with electric voltage is configured to:

increase the electric voltage of the spark plug from a zero voltage to a first voltage stage created at an electric voltage value just necessary for formation, at a free end of an electrode of the spark plug, of first electric filaments originating from the free end;

stabilize, after increasing the electric voltage to the first voltage stage, the electric voltage at the first voltage stage for a predetermined time period; and increase, after stabilizing the electric voltage at the first voltage stage, the electric voltage up to the adapted voltage.

8. The device as claimed in claim 7, wherein the means for powering the spark plug includes a radio frequency power supply.

9. An internal combustion engine comprising the device as claimed in claim 7.

* * * * *